United States Patent [19]

Motta et al.

[11] Patent Number: 4,747,711

[45] Date of Patent: May 31, 1988

[54] CARTRIDGE FOR AN INKED RIBBON WITH A RE-INKING DEVICE

[75] Inventors: Carlo Motta, Borgofranco; Aldo Ricca, Rivarolo; Walter Trimboli; Bruno Fausto, both of Turin, all of Italy

[73] Assignee: Ing. C. Olivetti & C., S.p.A., Ivrea, Italy

[21] Appl. No.: 12,140

[22] Filed: Feb. 9, 1987

[30] Foreign Application Priority Data

Feb. 28, 1986 [IT] Italy ..... 67166 A/86

[51] Int. Cl.[4] ..... B41J 32/02; B41J 27/12

[52] U.S. Cl. ..... 400/196.1; 400/202.4; 400/208

[58] Field of Search ..... 400/194–196.1, 400/208, 202–202.4

[56] References Cited

U.S. PATENT DOCUMENTS

| | | | |
|---|---|---|---|
| 4,115,012 | 9/1978 | Ploeger | 400/202.1 |
| 4,130,367 | 12/1978 | Guerrini | 400/196 X |
| 4,279,519 | 7/1981 | Shiurila | 400/202.2 X |
| 4,340,313 | 7/1982 | Bishop | 400/202.1 |
| 4,465,388 | 8/1984 | Iwasawa | 400/202.1 X |
| 4,616,942 | 10/1986 | Nagasawa | 400/195 X |
| 4,639,153 | 1/1987 | Cheng | 400/202.1 |

FOREIGN PATENT DOCUMENTS

| | | | |
|---|---|---|---|
| 676889 | 12/1963 | Canada | 400/202.4 |
| 167892 | 1/1986 | European Pat. Off. | 400/196.1 |
| 2544666 | 10/1984 | France | 400/202.4 |
| 57-82 | 1/1981 | Japan | 400/196 |

*Primary Examiner*—Paul T. Sewell

*Attorney, Agent, or Firm*—Banner, Birch, McKie & Beckett

[57] ABSTRACT

A re-inking device is fitted to a cartridge for an inked ribbon. The cartridge comprises a magazine housing the ribbon which is of the closed loop type and which is disposed in randomly distributed loops, and a pair of rollers for the unidirectional feed movement of the ribbon. The re-inking device comprises an ink reservoir or inker, an ink metering wick and a spring. The pair of rollers comprises two toothed wheels and the inker is disposed in a housing adjacent to the wheels. The ink metering wick comprises a bundle of capillary fibres and is disposed between the inker and the wheel. The spring presses on the metering wick to hold the fibres at one end in constant contact with the outside surface of the wheel. The crests of the teeth of the wheels are of a rounded section and the inker is of a parallelepipedic shape, is of polyester fibres with external co-extrusion and contains an amount of ink such as to occupy only half the volume of the inker. The metering wick is cylindrical and is of a longitudinal section of rhomboidal shape. The bunch of capillary filaments is formed by fibres of elasticized nylon impregnated with phenol resin. The ends of the capillary filaments co-operate with the rounded crests of the teeth of the wheel and the spring acts on the side surface of the capillary filaments to hold the ends of the filaments and the teeth of the wheel in constant contact.

6 Claims, 2 Drawing Sheets

CARTRIDGE FOR AN INKED RIBBON WITH A RE-INKING DEVICE

BACKGROUND OF THE INVENTION

The present invention relates to cartridges for an inked ribbon with a re-inking device, of the type having a magazine for housing the inked ribbon of the closed loop type disposed in randomly distributed loops, and a pair of rollers for the feed movement of the inked ribbon, and in which the re-inking device comprises an inker and an ink metering means.

In a known cartridge of that type, the metering means is a felt member or a blade member in contact with the roller for producing the feed movement. The felt metering member is partially housed in an inker and a spring urges the inker with the metering means thereof against the feed movement roller. The re-inking device suffers from the disadvantage of being of relatively high cost due to the need for assembling the inker with the metering means thereof. In addition both the felt member and the blade member do not ensure optimised constancy in respect of the feed flow and run of the ink and thus make re-inking of the ribbon difficult.

SUMMARY OF THE INVENTION

The object of the present invention is to provide a low-cost re-inking device which is simple, reliable and which at the same time is functional and practical.

To that end, the re-inking deviced for cartridges according to the invention is characterised in the manner set forth in claim 1.

BRIEF DESCRIPTION OF THE DRAWING

A preferred embodiment of the present invention is set forth in the following description which is given by way of non-limiting example and with reference to the accompanying drawing in which.

DESCRIPTION OF THE PREFERRED EMBODIMENT

Figure 1:
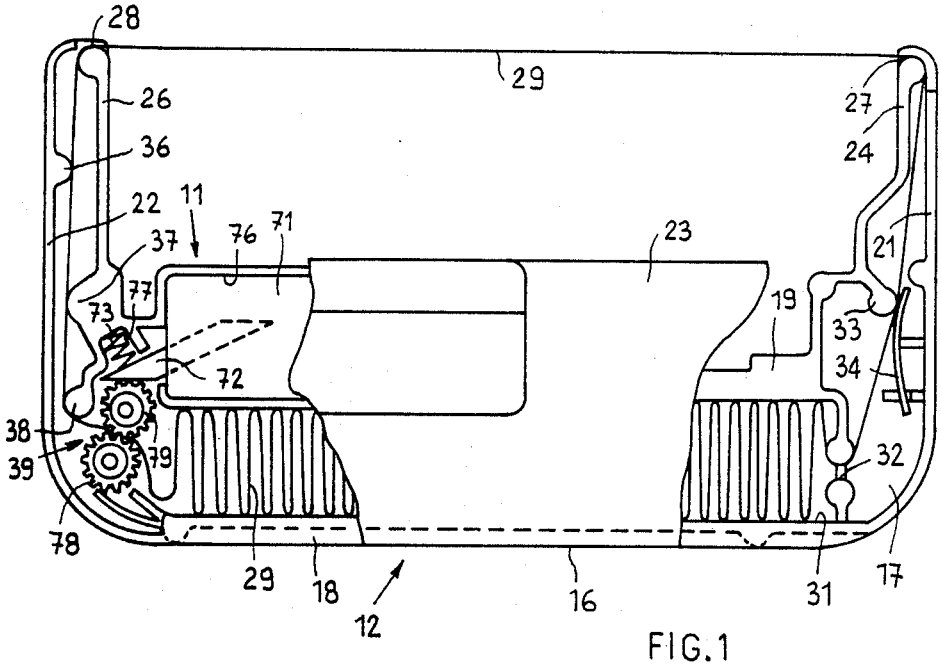
FIG. 1 is a plan view of part of a first cartridge with the re-inking device according to the invention.
Figure 2:
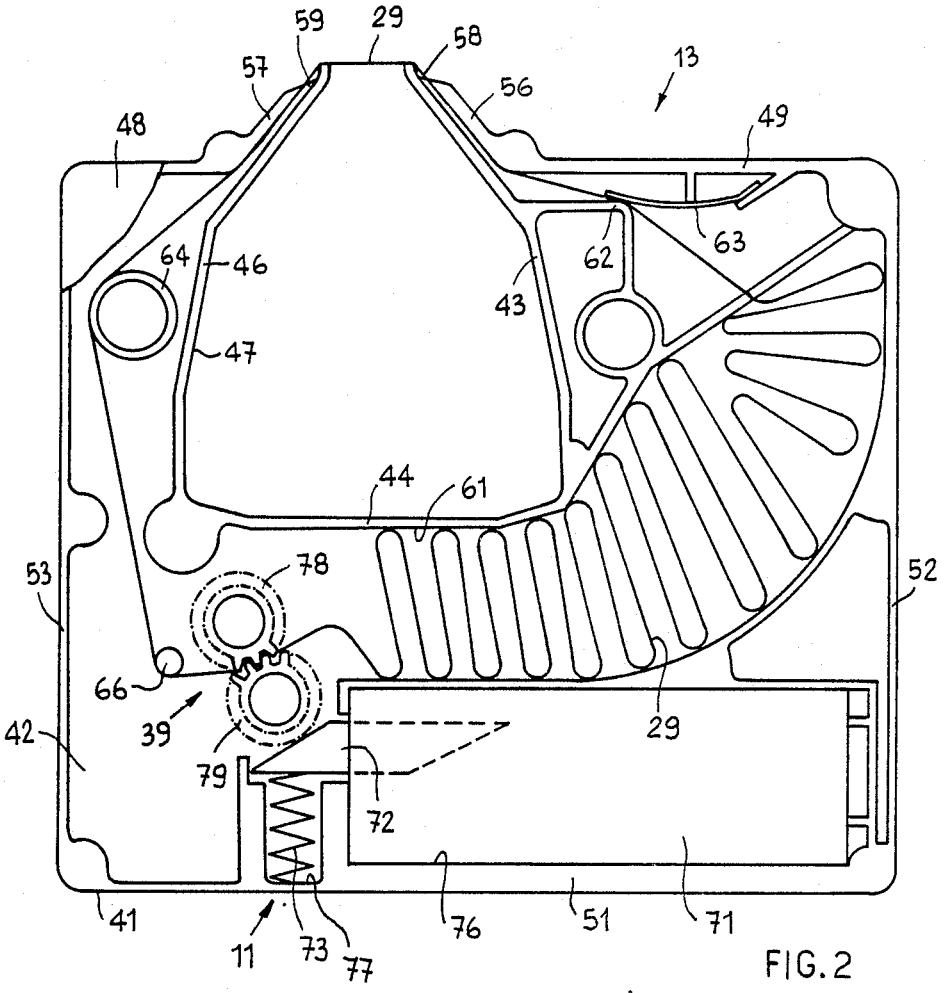
FIG. 2 is a plan view of part of a second cartridge using the re-inking device of FIG. 1, on an enlarged scale.

The re-inking device which is generally indicated by reference numeral 11 is used by way of example in a cartridge 12 (see FIG. 1) and a cartridge 13 (see FIG. 2). Since the two cartridges 12 and 13 are not subject-matter of the present invention, they are only partly described herein in order better to specify use of the re-inking device 11. In particular the cartridge 12 (see FIG. 1) comprises a casing 16 of a substantially parallelepipedic elongate shape with the corners thereof connected and rounded. The casing 16 comprises a bottom 17, a front wall 18, a rear wall 19, two side walls, namely a right-hand side wall 21 and a left-hand side wall 22, and a cover 23 which closes the casing 16 upwardly.

The cartridge 12 has two arms 24 and 26 which project from the rear wall 19 and which each have an opening 27 and 28 respectively to permit a portion of inked ribbon 29 to be passed and guided therethrough. The inked ribbon 29 is of the closed loop type and is disposed in randomly distributed turns in a magazine 31 in the casing 16. The magazine 31 has an exit 32 for the inked ribbon 29 to pass therethrough. The ribbon 29 is pinched between a fixed pin portion 33 and a resilient blade member 34 to prevent more turns of ribbon from coming out of the magazine and to tension the ribbon 29. The ribbon 29 then passes into the opening 27, coming out of the casing 16, and re-enters by way of the opening 28 and, being guided by fixed pin portions 36, 37 and 38, is engaged by a pair of rollers which are generally indicated by reference numeral 39, for the unidirectional feed movement, and is then passed into the magazine 31 again.

The cartridge 13 (see FIG. 2) comprises a casing 41 formed by a bottom 42 and a series of internal walls 43, 44 and 46 defining a space or cavity 47. The casing 41 is closed upwardly by a cover 48, a rear wall 49, a front wall 51 and a right-hand side wall 52 and a left-hand side wall 53.

The cartridge 13 comprises two suitably shaped arms 56 and 57 which project from the rear wall 49 and which at their ends have two openings 58 and 59 respectively to permit a portion of the inked ribbon 29 to be passed therethrough and guided on the exterior of the cartridge. The inked ribbon 29 is the same as that in the cartridge 12 (FIG. 1), is of the closed loop type and is disposed in randomly distributed turns in a magazine 61 (see FIG. 2) in the casing 41. The inked ribbon 29 issues from the magazine 61, and is then gripped between a fixed wall 62 and a resilient blade member 63 for preventing more turns from coming out of the magazine and for tensioning the ribbon 29. The ribbon 29 then passes into the opening 58, leaving the casing 41, and re-enters by way of the opening 59 and, guided by fixed pin portions 64 and 66, is engaged by the pair of rollers generally indicated by reference numeral 39 for the unidirectional feed movement and is then passed into the magazine 61 again.

To simplify the description, identical parts of the two cartridges 12 and 13 are denoted by the same reference numerals: re-inking device 11, inked ribbon 29 and pair of feed rollers 39.

Figure 4:
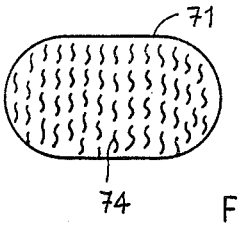
FIG. 4 is a front view of part of the arrangement shown in FIG. 1 on an enlarged scale, showing another detail thereof.

Referring to FIGS. 1 and 2, the re-inking device 11 comprises a reservoir for the ink or inker 71, an ink metering means 72 and a spring 73. The inker 71 is of a parallelepipedic shape of rectangular section with rounded edges, is of a material comprising polyester fibres with external co-extrusion and is capable of containing ink 74 (see FIG. 4) in such an amount that the ink 74 occupies only half the volume of the inker 71. The inker 71 is housed in a seat 76 in the casings 16 (FIG. 1) and 41 (FIG. 2).

Figure 3:
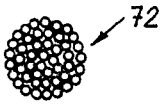
FIG. 3 is a front view of part of the arrangement shown in FIG. 1 on an enlarged scale, illustrating a detail thereof.

The ink metering means 72 is substantially cylindrical and its longitudinal section is of rhomboidal shape while its cross-section is circular (see FIG. 3). It is formed by a rigid bunch of capillary filaments of elasticated nylon fibres. The fibres are slightly impregnated with a phenol resin which however leaves capillary spaces between the filaments such as to provide for capillary flow of the ink 74 therethrough. The number of filaments contained in the rigid bunch of capillary filaments is of a predetermined density such as to provide a level of permeability such as to optimise the amount and flow of the ink 74 from the inker 71 to the pair of rollers 39. The spring 73 is fitted between a seat 77 of the casings 16 (FIG. 1) and 41 (FIG. 2) and the outside longitudinal edge of the inker 72.

Figure 5:
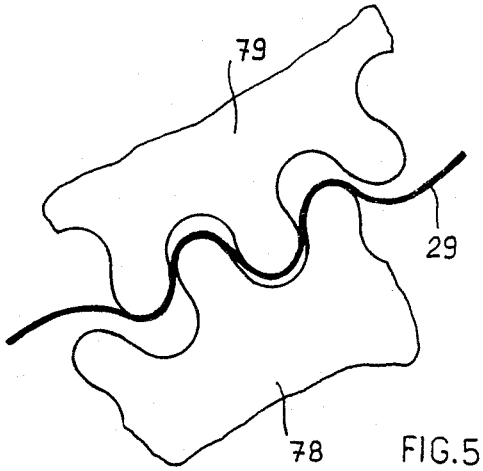
FIG. 5 is a plan view of part of some details from FIGS. 1 and 2 on an enlarged scale.

The pair of feed rollers 39 (see FIGS. 1 and 2) comprises two toothed wheels 78 and 79 in which the addenda of the teeth are of rounded section. The spring 73 holds the ends of the filaments of the ink metering means 72 always in engagement with the outside surface of the teeth of the toothed wheel 79 and thus the ink 74 is deposited on the outside surface of the teeth and during the rotary movement of the wheels 78 and 79 (see FIG. 5), besides causing unidirectional feed movement of the ribbon 29, the wheel 79 transfers the ink 74 which is on the outside rounded surface of the teeth, as can be clearly seen from FIG. 5. The mode of operation and the rotary movement of the feed rollers 39 are substantially the same as those described in British patent specification GB No. 1595447.

It will be apparent therefore that the ink metering means 72, being rigid, always remains in contact with the cylindrical surface of the teeth of the toothed wheel 79, due to the force of the spring 76 which acts on the longitudinal edge of the metering means 72.

Since the bunch of fibres has a rhomboidal shape, it is apparent that both its ends are bevelled ends.

What we claim is:

1. A cartridge for an inked ribbon with a re-inking device, comprising a casing having an inked ribbon; a magazine for housing the inked ribbon, wherein the inked ribbon is of the closed loop type and is disposed in randomly distributed turns; and a pair of rollers nipping a portion of said inked ribbon for its feeding, and in which the re-inking device comprises an ink reservoir, and ink metering means, and an ink housed in the ink reservoir, wherein said casing comprises a first seat positioned adjacent to the magazine and having an aperture positioned adjacent to the pair of rollers, and a second seat positioned adjacent to the first seat and having an aperture adjacent to the aperture of the first seat and to the pair of rollers;

wherein said ink reservoir is of a parallelepipedic shape of rectangular section with rounded edges, is housed in said first seat and has an open end positioned in correspondence with the aperture of said first seat;

wherein the ink metering means is substantially cylindrical and its longitudinal section is of rhomboidal shape while its cross-section is circular, wherein said ink metering means is made of a rigid bunch of capillary filaments of elastic fibers, which are slightly impregnated with a phenol resin, which leaves capillary spaces between the filaments such as to provide for capillary flow of the ink therethrough, and wherein a first end of the ink metering means is inserted in the ink reservoir through the open end and a second end of the ink metering means is engaged with one roller of said pair of rollers, and wherein said re-inking device comprises resilient means housed in said second seat and fitted between a bottom of the second seat and an outside longitudinal edge of the second end of the ink metering means for holding the second end always engaged and in contact with said one roller for capillary flow of the ink from the reservoir to said one roller.

2. A cartridge according to claim 1, wherein the pair of rollers comprises two toothed wheels having the ends of the teeth of a rounded section-shape, wherein the ink reservoir is made of polyester fibers with co-extrusion and is capable of containing the ink in such an amount that the ink occupies only half the volume of the ink reservoir, wherein the number of filaments of the ink metering means contained in said rigid bunch of capillary filaments is of a predetermined density such as to provide a level of permeability such as to optimize the amount and flow of the ink from the ink reservoir to one of the two toothed wheels, and wherein the resilient means comprise a spring which holds the ends of the capillary fibers against the rounded ends of the teeth of the one of the two toothed wheels.

3. A cartridge for an inked ribbon with a re-inking device, comprising a casing having an inked ribbon, a magazine for housing the inked ribbon which is of the closed loop type and is disposed in randomly distributed turns, and a pair of rollers, and in which the re-inking device comprises an ink reservoir, an ink metering means, and an ink housed in the ink reservoir and accommodating means in said casing for accommodating said ink reservoir;

wherein the ink reservoir comprises a parallelepipedic body having an axial recess filled with fibers in which said ink is housed and wherein said body has an open end positioned in correspondence with said pair of rollers and allowing direct access to the fibers filling said body;

wherein the ink metering means has a substantially cylindrical shape and its longitudinal uniform cross-sectional configuration formed with a relatively rigid bunch of capillary filaments of elastic fibers, which are slightly impregnated with a resin, which leaves capillary spaces between the filaments such as to provide for capillary flow of the ink therethrough, wherein said bunch of capillary filaments comprises a first and a second end delimited by a bevelled surface, wherein the first end of the ink metering means is inserted among the fibers of said ink reservoir through the open end and the second end of the ink metering means projects from the first aperture of said parallelepipedic body toward one roller of said pair of rollers, and wherein the re-inking device further comprises resilient means operative on a lateral portion of the second end of said ink metering means for holding an end of the capillary filaments of said second end to be always engaged and in contact with said one roller for capillary flow of the ink from the ink reservoir to said one roller through said fibers, and said first and second ends of said ink bunch of capillary filaments.

4. A cartridge according to claim 3, wherein the pair of rollers comprises two toothed wheels having the ends of the teeth of a rounded section-shape and wherein one end of the capillary filaments of the second end of said bunch of capillary filaments cooperates with the rounded ends of one of said toothed wheels constituting said one roller.

5. A cartridge according to claim 3, wherein the accommodating means of said casing comprise a first seat positioned adjacent to the magazine and having an aperture positioned adjacent to the pair of rollers, and a second seat positioned adjacent to the first seat and having an aperture positioned adjacent to the aperture of the first seat and to the pair of the rollers wherein said parallelepipedic body has a rectangular section with rounded edges, housed in said first seat and wherein the resilient means comprise a spring housed in the second seat and fitted between a bottom of said second seat and the lateral portion of said second end of the bunch of capillary filaments.

6. A cartridge according to claim 3 wherein the parallelepipedic body of said ink reservoir is made of a co-extrusion with polyester fibers and is capable of containing the ink in such an amount that the ink occupies only half the volume of the ink reservoir, wherein the number of filaments of the ink metering means contained in the rigid bunch of capillary filaments is of a predetermined density such as to provide a level of permeability such as to optimize the amount and flow of the ink from the ink reservoir to said roller.

* * * * *